US010240882B1

(12) United States Patent
Hoffman

(10) Patent No.: US 10,240,882 B1
(45) Date of Patent: Mar. 26, 2019

(54) CRUSH INDUCING CARTRIDGE CHAMBER

(71) Applicant: The United States of America as Represented by the Secretary of the Army, Washington, DC (US)

(72) Inventor: Brian R. Hoffman, Bangor, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/127,441

(22) Filed: Sep. 11, 2018

Related U.S. Application Data

(60) Provisional application No. 62/631,578, filed on Feb. 16, 2018.

(51) Int. Cl.
*F41A 21/00* (2006.01)
*F41A 21/12* (2006.01)

(52) U.S. Cl.
CPC ..... *F41A 21/12* (2013.01)

(58) Field of Classification Search
CPC ..... F41A 21/12; F41A 21/14
See application file for complete search history.

(56) References Cited

U.S. PATENT DOCUMENTS

| | | | | |
|---|---|---|---|---|
| 1,376,530 | A | 5/1921 | Harry | |
| 1,470,591 | A * | 10/1923 | Manoel | F42B 5/073 102/430 |
| 2,831,287 | A * | 4/1958 | Maillard | F41A 21/12 102/430 |
| 3,209,691 | A * | 10/1965 | Herter | F42B 5/28 102/464 |
| 3,858,342 | A * | 1/1975 | Langsford | F41A 21/12 42/16 |
| 3,935,816 | A | 2/1976 | Boquette | |
| 4,726,296 | A | 2/1988 | Leshner | |
| 6,860,207 | B1 | 3/2005 | Robertson | |
| 8,408,137 | B2 | 4/2013 | Battaglia | |
| 8,443,730 | B2 | 5/2013 | Padgett | |
| 8,869,702 | B2 | 10/2014 | Padgett | |
| 9,404,719 | B1 * | 8/2016 | Bowers | F42B 5/025 |

FOREIGN PATENT DOCUMENTS

| | | | | |
|---|---|---|---|---|
| GB | 861718 A * | 2/1961 | | F41A 21/12 |

* cited by examiner

*Primary Examiner* — Gabriel J. Klein
(74) *Attorney, Agent, or Firm* — John P. DiScala

(57) ABSTRACT

A bottleneck cartridge chamber wherein a circumferential relief recess is placed within the shoulder region of the chamber. As opposed to the continuous angled shoulder of conventional cartridge chambers, the proposed relief recess is envisioned as an angular segment of larger included angle than the conventional chamber shoulder angle (thereby creating a compound angle cartridge chamber shoulder region) or a radial recess that would eliminate a portion of the conventional chamber shoulder.

16 Claims, 8 Drawing Sheets

CRUSH INDUCING CARTRIDGE CHAMBER

CROSS-REFERENCE TO RELATED APPLICATIONS

This application claims the benefit under 35 USC § 119(e) of U.S. provisional patent application 62/631,578 filed on Feb. 16, 2018.

STATEMENT OF GOVERNMENT INTEREST

The inventions described herein may be manufactured, used and licensed by or for the United States Government.

BACKGROUND OF THE INVENTION

The invention relates in general to firearms and more specifically to firearm chambers.

A significant and longstanding deficiency inherent to bottleneck ammunition cartridge case designs is that they allow for only a very small amount of case crush during locking of the firearm bolt for a given amount of input force and energy. This deficiency is widespread in both military and commercial applications and affects conventional as well as developmental cartridge designs independent of particular case material.

Headspace is a fundamentally important characteristic to both the firearm and. ammunition designer and is the distance from the feature in the cartridge chamber that limits forward movement of the cartridge to the feature in the firearm locking mechanism that limits rearward movement of the cartridge. In the vast majority of firearms, the cartridge chamber is an integral part of the gun barrel, and the bolt face is the feature in the firearm locking mechanism that limits rearward movement of the cartridge. In production firearms, headspace is not a singular value but rather a defined range of acceptable values to allow for component level manufacturing tolerances and/or assembly tolerances. In addition to allowable headspace tolerance, the cartridge case itself also has a manufacturing tolerances to include acceptable deviations in the portion of its length that interacts with the headspace controlling features of the firearm mechanism as previously described.

Prior Art FIG. 1 shows a cross sectional view of a conventional firearm breech for a firearm configured to fire ammunition with a bottleneck configuration. Prior Art FIG. 2 shows an enlarged view of a conventional cartridge chamber for a weapon configured to fire ammunition with a bottleneck configuration. The breech comprises a barrel, a barrel extension, a conventional bottleneck cartridge chamber and a bolt. The chamber further comprises a chamber shoulder region.

Prior Art FIG. 3 shows a cross sectional view of a conventional firearm breech with a chambered bottleneck ammunition cartridge. The interior profile of the chamber is sized and dimensioned to receive a bottleneck cartridge case. The bottleneck ammunition cartridge sits in the chamber. Prior Art FIG. 4 shows an enlarged view of an interface of a conventional cartridge chamber and a bottleneck ammunition cartridge. The conventional chamber shoulder region supports the neck of the conventional bottleneck cartridge with the interior profile of the chamber substantially matching the exterior profile of the cartridge case within manufacturing tolerances.

For example, consider a bottleneck cartridge in caliber .308 Winchester, which is a close commercial equivalent to the popular military 7.62×51 mm NATO caliber. The Sporting Arms and Ammunition Manufacturers' Institute (SAAMI) recommended chamber headspace and case length limits are defined in publication ANSI/SAAMI Z299.4-2015 which is hereby incorporated by reference. The recommended range of chamber headspace values for this particular caliber are 1.630-1.640 inches. The recommended range of values of the portion of the cartridge case length that interfaces with the chamber headspace controlling features are 1.634−0.007 inches, or 1.627-1.634 inches. If chamber headspace is at its minimum value of 1.630 inches and cartridge case length is at its maximum value of 1.634 inches, there will be an interference condition of 1.630-1.634 or −0.004 inch between the cartridge case head and the bolt face when the cartridge is fully chambered and the bolt is locked. If chamber headspace is at its maximum value of 1.640 inches and cartridge case length is at its minimum value of 1.627 inches, there will be a clearance condition of 1.640−1.627 or 0.013 inch between the cartridge case head and the bolt face when the cartridge is fully chambered and the bolt is locked.

In the minimum chamber and maximum case scenario, the resulting interference in the axial direction is referred to as case crush. As its name implies and in order to fully lock, the firearm locking mechanism must deform/crush the chambered cartridge case by an amount equal to the interference. In terms of practical implementation, ease of use, and maintaining reliable function, the maximum amount of case crush imposed by the firearm designer by way of chamber headspace definition, is limited by the required amount of input force and energy to crush the case. For manually operated firearms (bolt action rifle, for example), if too much case crush were imposed, the operator may not be able to lock the bolt as the force required to do so may exceed what is achievable by a person of typical stature and strength. For self-powered, auto cycling firearms (open bolt fired Machine gun, for example), excessive case crush demands may require an amount of energy that exceeds the percentage of firearm operating group counter recoil energy available for this specific event resulting in either the locking mechanism being unable to fully lock or, if able to fully lock, reducing the firing pin impact velocity and/or impact energy to the point of inducing cartridge misfires.

In the maximum chamber and minimum case scenario, clearance in the axial direction exists between the locked bolt face and chambered cartridge case head. The amount of possible clearance is effectively limited by the material properties of the cartridge case and its ability to accommodate deformation without structural compromise or failure. From a producibility perspective in terms of reducing manufacturing costs, it is preferable to impose chamber headspace limits that allow for the maximum amount of clearance as this translates into larger tolerances for the manufacture and assembly of the firearm components that contribute to chamber headspace. The downsides to increasing clearance, however, are in accepting a decreased level of position control of the chambered cartridge as well additional structural demands on the bolt locking features due to the impulsive impact load applied by the case head to the bolt face during firing. Decreased position control of the chambered cartridge leads to inconsistencies in the initial launch angle of the bullet as it departs the case, which subsequently contributes to degraded downrange accuracy and precision. As for the impact loading of the case head onto the bolt face during firing, this phenomena is often addressed by the firearm designer by applying a load/scale factor to the combined stress calculations governing the bolt features that structurally support the firing event. An impact load factor is applied to the pressure induced stresses in order to ensure survivability and/or acceptable fatigue life. If the firing forces were not of an impactful nature, bolt life would immediately increase (without any design changes), or the bolt could be redesigned to a smaller/lighter version (while maintaining same life expectations of existing bolt).

In summary, bottleneck cartridge case designs inherently limit the amount of case crush achievable during locking of the firearm bolt, which subsequently leads to allowable clearance between the bolt face and cartridge case head when firing production ammunition. This has three unique and significant consequences. The first is degraded firing accuracy and precision. The second is that increased structural demands are placed on the locking features of the bolt, which leads to decreased life or larger/heavier designs. The third is that it limits the allowable manufacturing and assembly tolerances for components influencing chamber headspace, which increases cost.

A need exists for a chamber which induces a more substantial amount of case crush to take place during the locking of the firearm bolt.

SUMMARY OF INVENTION

A bottleneck cartridge chamber wherein a circumferential relief recess is placed within the shoulder region of the chamber. As opposed to the continuous angled shoulder of conventional cartridge chambers, the proposed relief recess is envisioned as an angular segment of larger included angle than the conventional chamber shoulder angle (thereby creating a compound angle cartridge chamber shoulder region) or a radial recess that would eliminate a portion of the conventional chamber shoulder.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

Prior Art

Prior Art

Prior Art

Prior Art

DETAILED DESCRIPTION

Figure 1:
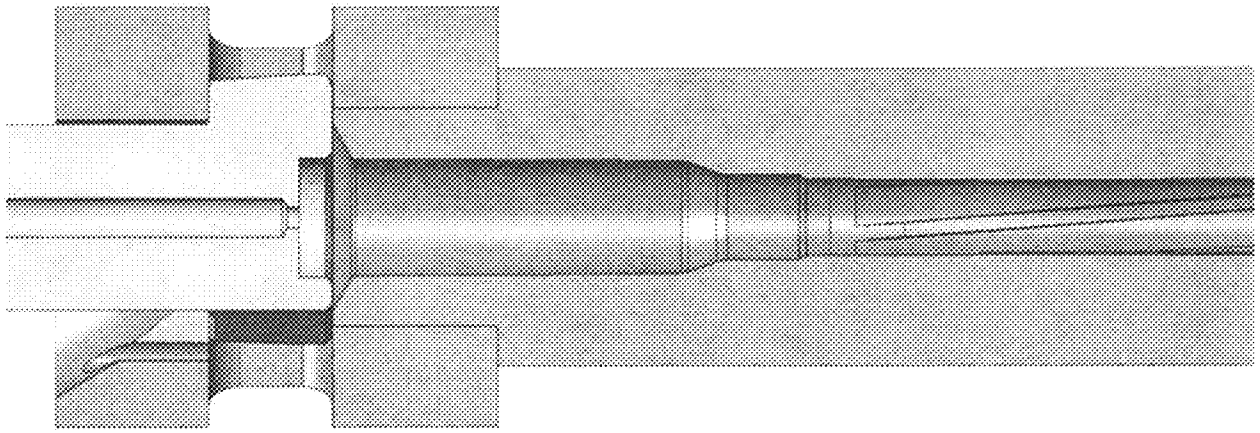
FIG. 1 (Prior Art)
FIG. 1 shows a cross sectional view of a conventional firearm breech for a firearm configured to fire ammunition with a bottleneck configuration.
Figure 2:
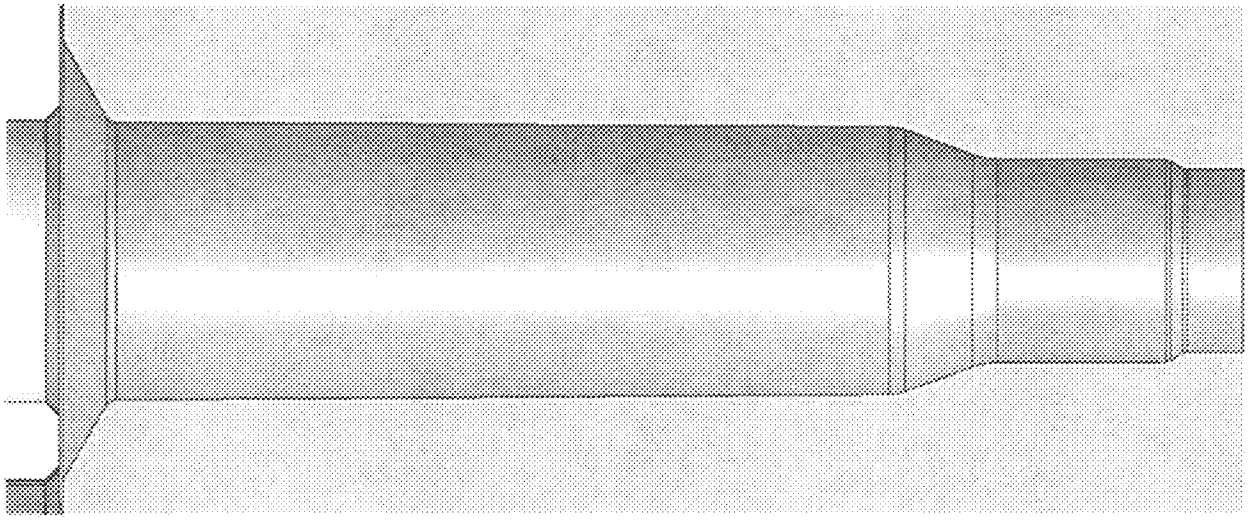
FIG. 2 (Prior Art)
FIG. 2 shows an enlarged view of a conventional cartridge chamber for a weapon configured to fire ammunition with a bottleneck configuration.
Figure 3:
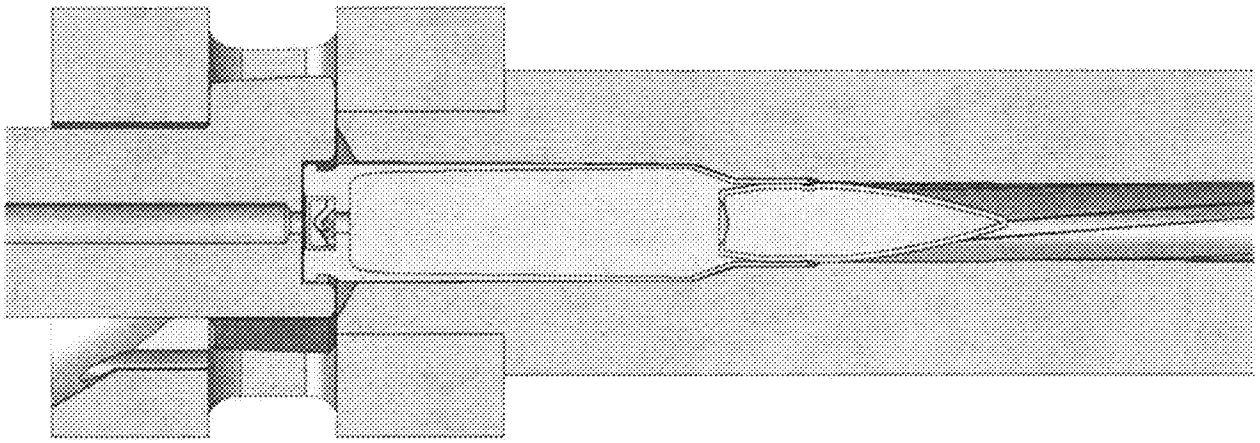
FIG. 3 (Prior Art)
FIG. 3 shows a cross sectional view of a conventional firearm breech with a chambered bottleneck ammunition cartridge.
Figure 4:
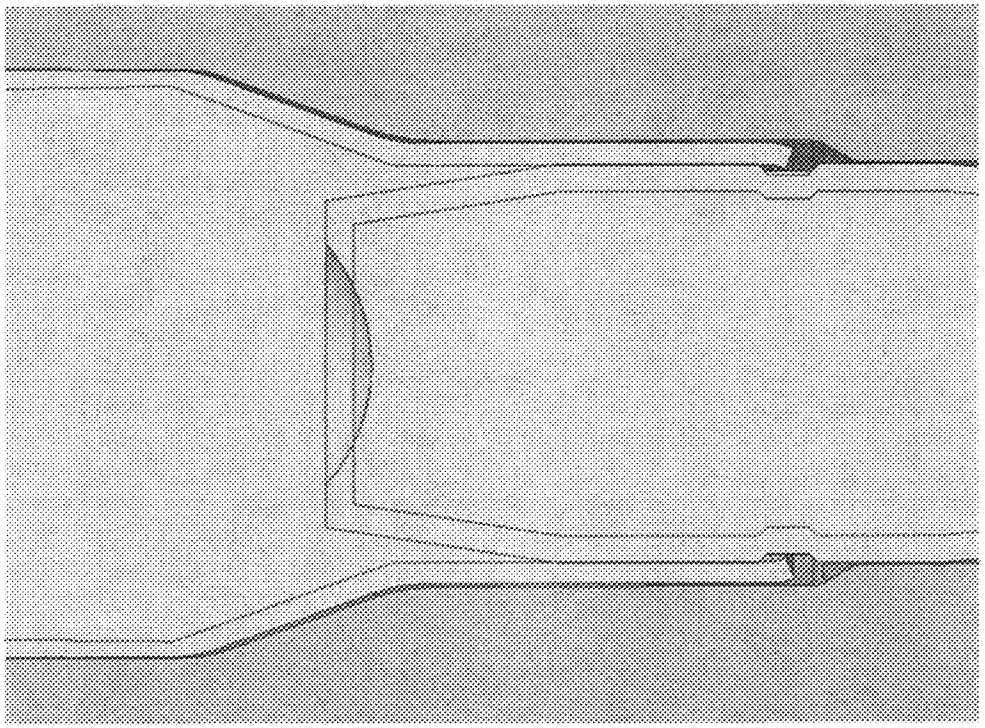
FIG. 4 (Prior Art)
FIG. 4 shows an enlarged view of an interface of a conventional cartridge chamber and a bottleneck ammunition cartridge.

A bottleneck cartridge chamber comprises a shoulder region wherein an inner profile of the shoulder region of the chamber is not sloped at a continuous angle such that a circumferential relief recess is formed by the discontinuity. As opposed to the continuous angled shoulder of conventional cartridge chambers, the relief recess is envisioned as an angular segment of larger included angle than the conventional chamber shoulder angle (thereby creating a compound angle cartridge chamber shoulder region) or a radial recess that would eliminate a portion of the conventional chamber shoulder.

While the term recess is used throughout the specification, this term refers to the geometric feature defined by the inner surface Of the cartridge chamber and not the method of forming the geometric feature. In certain embodiments, the recess may be formed by the removal of cartridge chamber material. In other embodiments, the recess is formed integrally with the cartridge chamber.

Throughout the specification, the crush inducing cartridge chamber is described as benefitting small caliber weapons firing cartridges of a bottleneck configuration. In that regard, it is potentially applicable to applications utilizing bottleneck cartridges or any rim configuration (rimmed, semi-rimmed, rimless, rebated-rim, belted), or case material (metallic, polymer, hybrid, etc.). However, it is not limited to small caliber weapons and may also be applicable and beneficial to certain medium or even large caliber applications that may fire cartridges of a similar bottleneck style.

The advantages of a crush inducing cartridge chamber are significant and include (1) improved firing accuracy and precision, (2) increased life of firearm components that structurally support the forces generated during cartridge firing, and (3) ability to safely increase chamber headspace tolerances thereby reducing manufacturing and/or assembly costs of firearm components that contribute to chamber headspace control.

The crush inducing cartridge chamber may be exploited for a specific set of performance advantages depending on the class of firearms and functional priorities. Effectively, the increased level of case crush may be used to either (1) reduce or eliminate clearance between bolt face and cartridge ease head under all material tolerance conditions, (2) add to the allowable chamber headspace tolerance band, or (3) a combination of the two.

For applications that prioritize maximum firing accuracy and precision (sniper rifles, for example), the additional achievable amount of case crush would be applied to reduce or eliminate the axial clearance that would otherwise exist between bolt face and chambered cartridge case head. This would facilitate, while firing production ammunition assembled with new cases, the firing accuracy and precision gains that are typically associated with using reloaded ammunition assembled with fireformed cases. As an ancillary benefit, eliminating the clearance between bolt face and chambered cartridge case head would also enable an increase in bolt life as the geometric conditions that allow for impact loading during the firing event are eliminated.

For applications entertaining higher operating pressure cartridges that place increased structural demands on the bolt locking features, the additional achievable amount of case crush would also likely be applied to reduce or eliminate the axial clearance that would otherwise exist between bolt face and chambered cartridge case head as this would prevent impact loading during the firing event and subsequently reduce the defined safe working load governing the bolt locking lug design by an appreciable amount. The firing accuracy and precision gains would also be realized.

For applications that typically utilize conventional cartridges operating at conventional peak chamber pressures and wish to increase component life of the firearm bolt, once again the additional achievable amount of case crush of the compressible case would be applied to reduce or eliminate the axial clearance that would otherwise exist between bolt face and chambered cartridge case head as this would prevent impact loading during the firing event and reduce the shot-to-shot structural demands placed on the bolt. Component survivability and fatigue life would be improved. The firing accuracy and precision gains would also be realized.

For applications that typically utilize conventional cartridges operating at conventional peak chamber pressures and aren't overly concerned with improving current firing accuracy or precision (machine guns, for example), to reduce weapon component and assembly fabrication costs the crush inducing cartridge chamber may be implemented while still allowing for comparable levels of clearance between the bolt face and chambered cartridge case head as would exist with a conventional cartridge chamber. Taking this approach in combination with use of the crush inducing cartridge chamber would allow a reduction in the minimum chamber headspace dimension, which would increase the overall allowable tolerance of chamber headspace. This leads to increased component level and assembly tolerances for the firearms parts that contribute to headspace control. Larger tolerances lead to a reduction in fabrication costs and scrap rate.

While these previously described scenarios are merely examples of how the additional case crush may be leveraged to exploit specific advantages, the performance gains are substantial. Use of the crush inducing cartridge chamber enables a higher amount of case crush to take place per given unit of input force and energy. This increased case crush may then be exploited to improve firing accuracy and precision, increase the life of firearm components that structurally support the forces generated during cartridge firing, and increase chamber headspace tolerances thereby reducing manufacturing and/or assembly costs of firearm parts that contribute to chamber headspace control.

Figure 5:
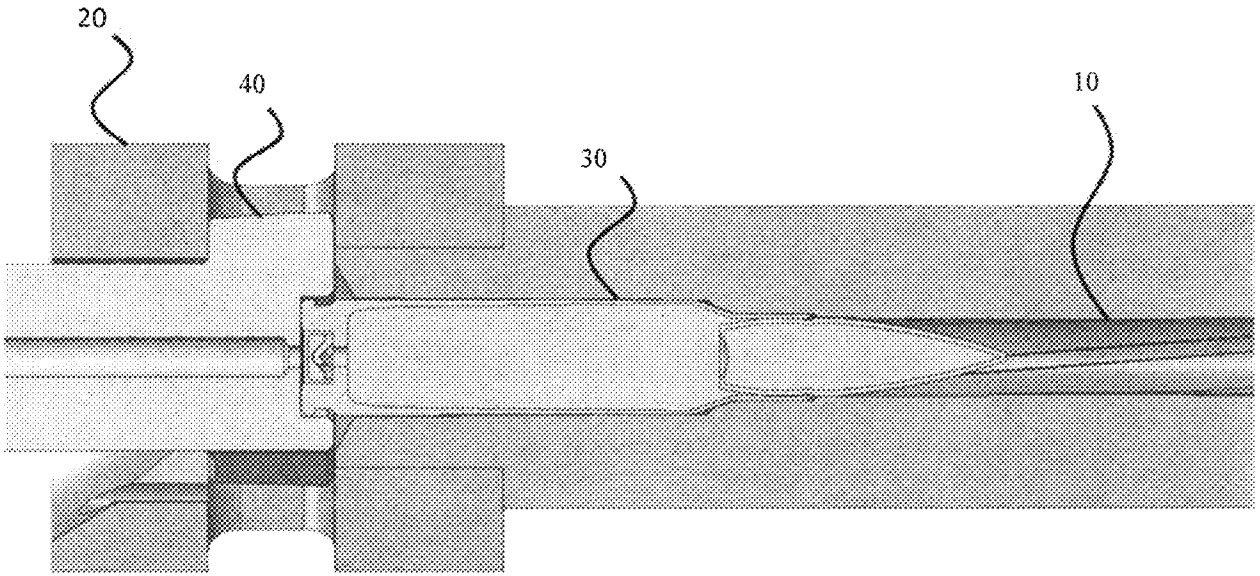
FIG. 5 shows a cross sectional view of a firearm breech comprising a crush inducing chamber and with a chambered bottleneck ammunition cartridge, in accordance with one embodiment.

FIG. 5 shows a cross sectional view of a firearm breech comprising a crush inducing chamber and with a chambered bottleneck ammunition cartridge, in accordance with one embodiment. The firearm breech comprises a barrel 10, a barrel extension 20, a cartridge chamber 30 and a bolt 40.

Figure 6:
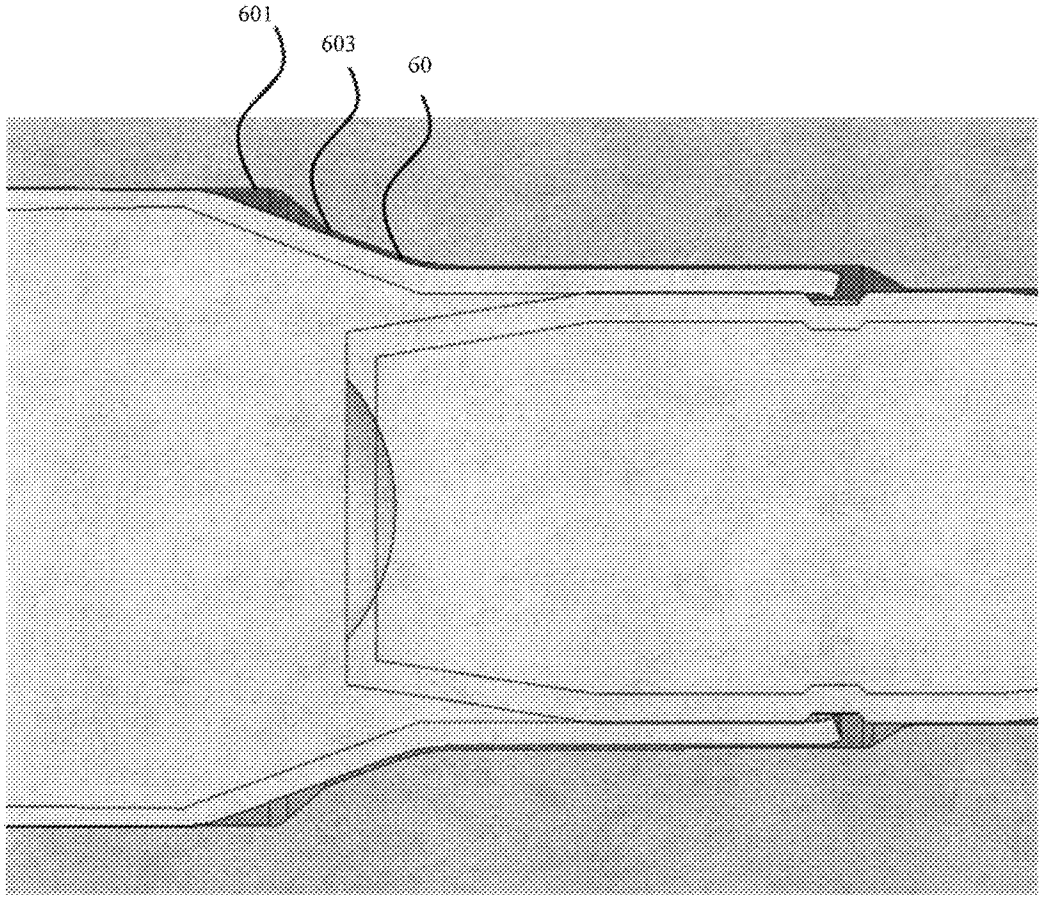
FIG. 6 shows an enlarged view of an interface of a crush inducing cartridge chamber and a bottleneck ammunition cartridge, in accordance with one embodiment.

FIG. 6 shows an enlarged view of an interface of a crush inducing cartridge chamber with an angular recess and a bottleneck ammunition cartridge, in accordance with one embodiment. The cartridge chamber 30 comprises a shoulder region 60 for interfacing with the shoulder portion of a cartridge case. The shoulder region 60 further comprises a circumferential relief recess 601 defined by the cartridge chamber 30 and extending fully around the circumference of the cartridge chamber. In the embodiment shown in FIGS. 5 and 6, the relief recess 601 is an angular relief recess 601 located at the rear of the shoulder region and proximate the body region of the cartridge chamber 30. The relief recess 601 creates a vertex 603 at the intersection of the chamber shoulder geometry segments.

Figure 7:
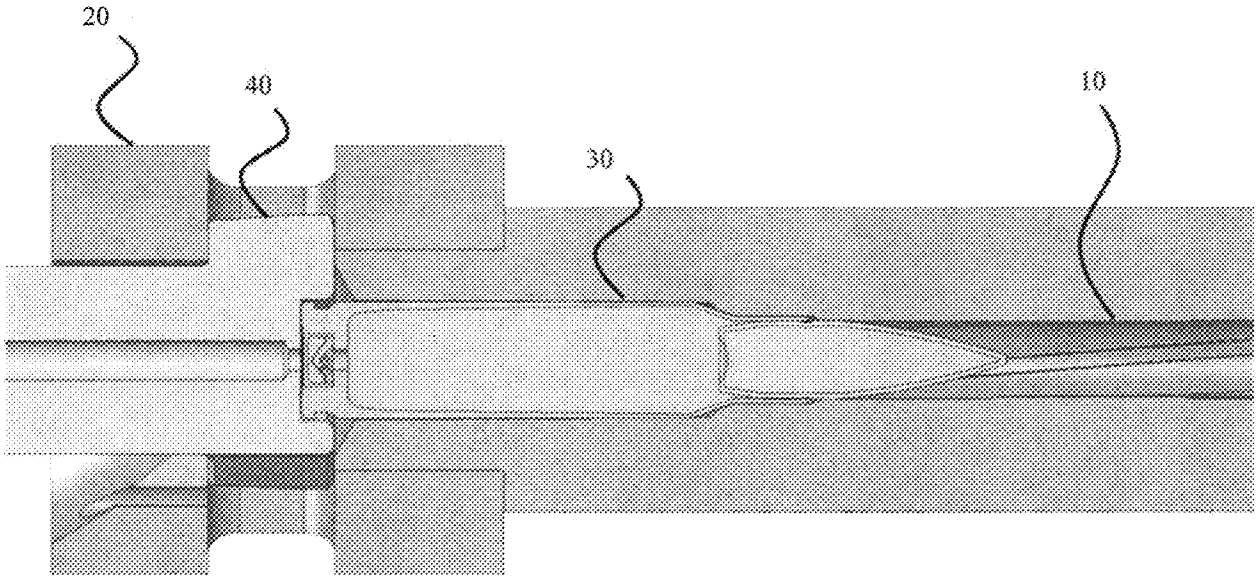
FIG. 7 shows a cross sectional view of a firearm breech comprising a crush inducing chamber and with a chambered bottleneck ammunition cartridge, in accordance with one embodiment.

FIG. 7 shows a cross sectional view of a firearm breech comprising a crush inducing chamber and with a chambered bottleneck ammunition cartridge, in accordance with one embodiment. The firearm breech comprises a barrel 10, a barrel extension 20, a cartridge chamber 30 and a bolt 40.

Figure 8:
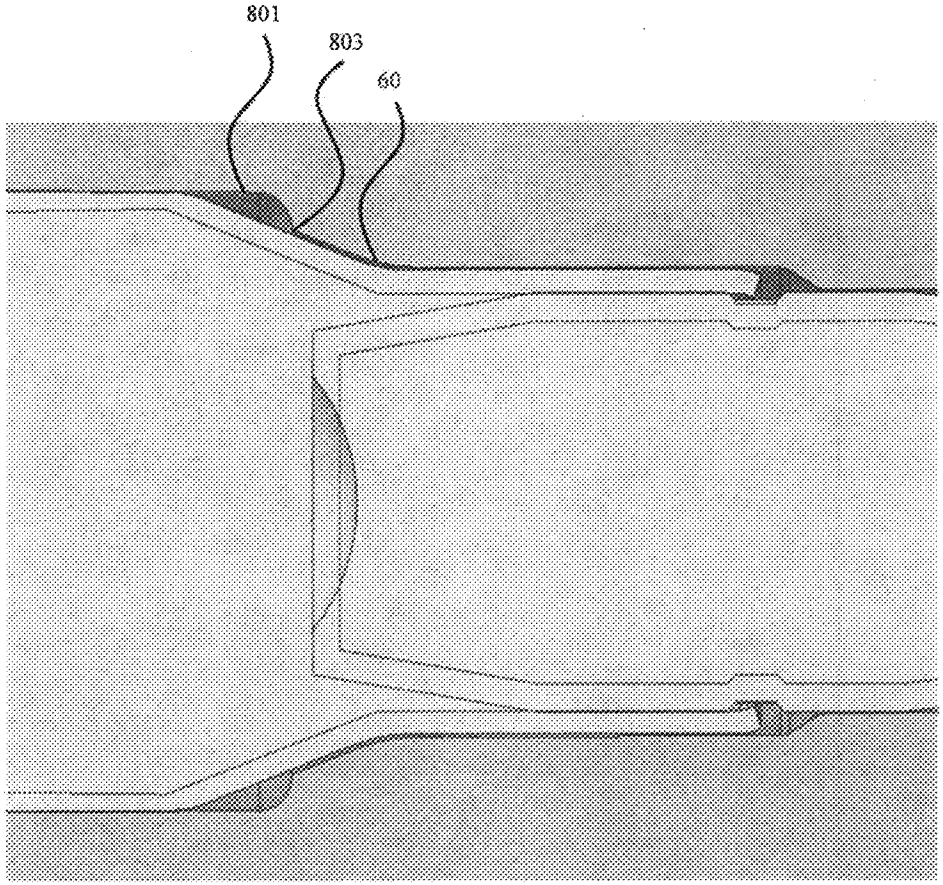
FIG. 8 shows an enlarged view of an interface of a crush inducing cartridge chamber and a bottleneck ammunition cartridge, in accordance with one embodiment.

FIG. 8 shows an enlarged view of an interface of a crush inducing cartridge chamber and a bottleneck ammunition cartridge, in accordance with one embodiment. The cartridge chamber 30 comprises a shoulder region 60 for interfacing with the shoulder portion of a cartridge case. The shoulder region 60 further comprises a circumferential relief recess 601 defined by the cartridge chamber 30 and extending fully around the circumference of the cartridge chamber. In the embodiment shown in FIGS. 7 and 8, the relief recess 801 is a radial relief recess 801 located at the rear of the shoulder region and proximate the body region of the cartridge chamber 30. The relief recess 801 creates a vertex 803 at the intersection of the chamber shoulder geometry segments.

As opposed to the continuous angled shoulder of conventional cartridge chambers, the proposed relief recess is envisioned as an angular segment of larger included angle than the conventional chamber shoulder angle (thereby creating a compound angle cartridge chamber shoulder region) or a radial recess that would eliminate a portion of the conventional chamber shoulder. Regardless of the specific geometry, the function of the relief recess is twofold. First, the relief recess creates a vertex at the intersection of the chamber shoulder geometry segments. When considering a planar cross section of the chamber geometry, the vertex may he ideally located at the traditional chamber shoulder datum location or slightly rearward of the traditional chamber shoulder datum toward the case head. With the relief recess being circumferential, the vertex sweeps the full diameter of cartridge chamber creating a continuous line defining the three dimensional intersection of the individual shoulder geometry surfaces. This resulting intersection, by its very nature as a line feature, enables high contact pressure with the shoulder of the incoming cartridge case as the firearm bolt moves forward during chambering and locking. This high contact pressure is leveraged to induce a controlled deformation of the cartridge case with the resulting case deflection occurring in the shoulder area and originating about the swept vertex. This intended deformation is achievable without the need for additional input force or energy from the firearm bolt because of the ability of the swept vertex feature to inflate the resulting contact pressure over what is typically achievable with the conventional surface-on-surface contact between cartridge and chamber shoulder surfaces.

Second, the relief recess creates a physical space claim for the deforming section of the incoming cartridge case, This is equally as important as inducing the deformation, as both characteristics are necessary in order to accommodate the increased levels of achievable case crush without an increase to the input force and energy.

The vertex is located at the conventional chamber shoulder datum location or slightly rearward of the location toward the chamber entrance for as this approach allows for the conventional chamber headspace control scheme to remain intact for bottleneck cartridges of rimless and rebated-rim configurations as well as certain belted configurations. More specifically, the conventional chamber shoulder datum remains and continues to function as the feature utilized in limiting forward travel of the chambered cartridge. Working within the confines of the first reason, the second reason then is that this approach establishes the longest possible moment arm for the section of the cartridge case shoulder that is undergoing the bending/deformation. Maximizing this moment arm length provides for the greatest potential deflection/deformation per unit input force and energy.

For any bottleneck cartridges of a rimmed or semi-rimmed configuration, the chamber feature may also be implemented and exploited for functional utility. From a design point of view, however, doing so would require concurrent and independent control of the overall allowable case crush along with the headspace limits. Unlike cartridges that control headspace from a datum located on the case shoulder, rimmed and semi-rimmed cartridges establish and control headspace at the case rim and based on the rim dimensions. This may require separately defined controls for the case crush and headspace characteristics.

The underlying intent in implementing the new chamber feature is to enable an additional amount of case crush during bolt lock-up given the same amount of input energy as compared to what is typically achievable with traditional chamber geometry.

The new chamber geometry may be easily fabricated by all methods used in establishing conventional cartridge chambers, whether that be through CNC or manually controlled machines and operations using standard or custom tooling. It is contemplated that companies specializing in chamber fabrication tooling may also develop chamber reamers that integrally include the new feature. Also, with the new feature only involving the removal of material from an existing bottleneck chamber, it is certainly possible to modify an existing cartridge chamber in order to exploit the functional advantages of the crush inducing cartridge chamber.

Much like conventional cartridge chamber geometries that are caliber specific, the novel chamber shoulder geometry of the crush inducing cartridge chamber is anticipated to be a caliber specific feature in terms of its exact profile, size, and location.

Additionally, should a cartridge be chambered in the Crush Inducing Cartridge Chamber and then removed without firing, there is nothing prohibitive from a functional or safety perspective in rechambering and firing the cartridge.

While the invention has been described with reference to certain embodiments, numerous changes, alterations and modifications to the described embodiments are possible without departing from the spirit and scope of the invention as defined in the appended claims, and equivalents thereof.

What is claimed is:

1. A bottleneck cartridge chamber for facilitating case crush in the axial direction, the bottleneck cartridge chamber comprising a shoulder region for interfacing with a shoulder portion of an ammunition case, the shoulder region having an inner profile sloped at a discontinuous angle thereby forming:

a relief recess defined by the shoulder region and extending circumferentially around the shoulder region; and a vertex located at a point of discontinuity on the inner profile, the vertex enabling high contact pressure with the shoulder portion of the ammunition case.

2. The bottleneck cartridge chamber of claim 1 wherein the relief recess is located at a rear of the shoulder region proximate to a body region of the bottleneck cartridge chamber.

3. The bottleneck cartridge chamber of claim 1 wherein the relief recess is an angular recess.

4. The bottleneck cartridge chamber of claim 1 wherein the relief recess is a radial recess.

5. The bottleneck cartridge chamber of claim 1 wherein the vertex is located approximately at a shoulder datum location.

6. The bottleneck cartridge chamber of claim 1 wherein the vertex is located rearward of a shoulder datum location.

7. The bottleneck cartridge chamber of claim 1 wherein the bottleneck cartridge chamber is sized and dimensioned to receive small caliber ammunition.

8. The bottleneck cartridge chamber of claim 1 wherein the relief recess is formed by removing material from the bottleneck cartridge chamber.

9. The bottleneck cartridge chamber of claim 1 wherein the relief recess is formed integrally with the cartridge chamber.

10. A bottleneck cartridge chamber for facilitating case crush in the axial direction, the bottleneck cartridge chamber comprising a shoulder region for interfacing with a shoulder portion of an ammunition case and having an inner profile, wherein the inner profile comprises a first face sloped at a first angle and a second face rearward of the first face and sloped at a second angle, the second angle being larger than the first angle thereby forming a circumferential relief recess defined by the shoulder region and extending circumferentially around the shoulder region and a vertex located at an intersection of the first face and the second face, the vertex enabling high contact pressure with the shoulder portion of the ammunition case.

11. The bottleneck cartridge chamber of claim 10 wherein an inner profile of the relief recess is angular.

12. The bottleneck cartridge chamber of claim 10 wherein an inner profile of the relief recess is radial.

13. The bottleneck cartridge chamber of claim 10 wherein the vertex is located approximately at a shoulder datum location.

14. The bottleneck cartridge chamber of claim 10 wherein the vertex is located rearward of a shoulder datum location.

15. The bottleneck cartridge chamber of claim 10 wherein the bottleneck cartridge chamber is sized and dimensioned to receive small caliber ammunition.

16. The bottleneck cartridge chamber of claim 10 wherein the relief recess is formed integrally with the cartridge chamber.

* * * * *